US005905419A

United States Patent [19]

Lukkarila

[11] Patent Number: 5,905,419

[45] Date of Patent: May 18, 1999

[54] TEMPERATURE COMPENSATION STRUCTURE FOR RESONATOR CAVITY

[75] Inventor: Teppo Matias Lukkarila, Hutchinson, Minn.

[73] Assignee: ADC Solitra, Inc., Hutchinson, Minn.

[21] Appl. No.: 08/878,495

[22] Filed: Jun. 18, 1997

[51] Int. Cl.[6] ..... H01P 1/20; H01P 7/04

[52] U.S. Cl. ..... 333/202; 333/222; 333/234

[58] Field of Search ..... 333/206, 208, 333/212, 224, 226, 227, 229, 233, 234, 222, 202

[56] References Cited

U.S. PATENT DOCUMENTS

| | | | |
|---|---|---|---|
| 2,103,515 | 12/1937 | Conklin et al. | 333/234 |
| 2,205,851 | 6/1940 | Hansell | 333/234 |
| 2,475,035 | 7/1949 | Linder | 333/229 |
| 3,048,803 | 8/1962 | Schanbacher | 333/229 |
| 3,108,240 | 10/1963 | Riblet | 333/229 |
| 3,252,116 | 5/1966 | Painter | 333/229 |
| 3,573,680 | 4/1971 | Carignan | 333/229 |
| 3,733,567 | 5/1973 | Johnson | 333/234 |
| 3,740,677 | 6/1973 | Kommrusch | 333/234 |
| 3,873,949 | 3/1975 | Dorsi et al. | 333/234 |
| 3,876,963 | 4/1975 | Graham | 333/227 |
| 4,057,772 | 11/1977 | Basil, Jr. et al. | 333/234 |
| 4,060,779 | 11/1977 | Atia et al. | 333/229 |
| 4,156,860 | 5/1979 | Atia et al. | 333/229 |
| 4,423,398 | 12/1983 | Jachowski et al. | 333/229 |
| 4,488,132 | 12/1984 | Collins et al. | 333/229 |
| 4,644,305 | 2/1987 | Tang et al. | 333/208 |
| 4,677,403 | 6/1987 | Kich | 333/229 |
| 5,012,211 | 4/1991 | Young et al. | 333/212 |
| 5,032,807 | 7/1991 | Petrovic | 333/176 |
| 5,304,968 | 4/1994 | Ohtonen et al. | 333/222 |
| 5,309,129 | 5/1994 | Arnold et al. | 333/229 |
| 5,589,807 | 12/1996 | Tang | 333/212 |

FOREIGN PATENT DOCUMENTS

| | | | |
|---|---|---|---|
| 0 540 360 A1 | 5/1993 | European Pat. Off. . | |
| 40 29 410 A1 | 3/1992 | Germany | 333/229 |
| 4029410 | 3/1992 | Germany | 333/229 |
| 41 13 302 A1 | 10/1992 | Germany | 333/229 |
| 4113302 | 10/1992 | Germany | 333/229 |
| WO 87/03745 | 6/1987 | WIPO . | |

OTHER PUBLICATIONS

"Reentrant Coaxial Resmators", Microwave Solid–State Design, John Wiley Pub. Co., 1988, p. 71.

*Primary Examiner*—Seungsook Ham
*Attorney, Agent, or Firm*—Merchant, Gould, Smith, Edell, Welter & Schmidt, P.A.

[57] ABSTRACT

For use with various types of devices conditioning radio signals, a temperature compensating cavity resonator includes a practicable and effective assembly. The resonator includes: a cavity resonator housing having an enclosing plate for enclosing the housing at a top edge, a base, and a surrounding wall extending from the top edge to the base; first and second opposing retainers located below the top edge and at the surrounding wall; a central post having a base end supported by the base of the housing and having a free end surface directed toward the top edge of the housing; and a temperature-compensating metal-based plate assembly including an upper strip extending from the first opposing retainer to the second opposing retainer and at a distance below the top edge, and including a lower strip having ends meeting the upper strip and having a center portion arranged over the free end surface and at a distance from the upper strip that varies in response to temperature to maintain a desired effect on energy passing through the cavity resonator housing.

19 Claims, 3 Drawing Sheets

TEMPERATURE COMPENSATION STRUCTURE FOR RESONATOR CAVITY

FIELD OF THE INVENTION

The invention relates generally to electrical resonators and, more particularly, to temperature compensation of a cavity resonator in which a metallic compensation structure is located in the resonator cavity.

BACKGROUND OF THE INVENTION

Radio frequency (RF) equipment uses a variety of approaches and structures for receiving and transmitting radio waves in selected frequency bands. Typically, filtering structures are used to maintain proper communication in frequency bands assigned to a particular band. The type of filtering structure used often depends upon the intended use and the specifications for the radio equipment. For example, dielectric and coaxial cavity resonator filters are often used for filtering electromagnetic energy in certain frequency bands, such as those used for cellular and PCS communications.

The resonant frequency of certain resonators, known as low power factor concentric conductor transmission line resonators, partly depends on the projected length of the inner conductor, which changes in response to temperature variations. In stabilizing the resonant frequency of the line against changes due to variations in temperature, temperature-induced changes in this length are balanced or counteracted by changes in other dimensions. These counteracting dimensional changes have been achieved in various ways. For example, if a copper plate is used to form a cup-shaped wall over the top of a center conductor in the resonator cavity, the change in temperature causes the distance between the free end of the center conductor and the copper plate to change. This change affects resonant frequency and can be used to stabilize the resonator over temperature.

Another such temperature compensation scheme, using this general approach, employs a stabilizer strip fixed to a top plate (or cover) over the resonator cavity and facing the end of the center conductor. Securing the stabilizer strip to the top plate is labor intensive and can cause the resonator to become mistuned. Moreover, because the stabilizer strip is secured to the top plate, which is a relatively fixed point, differences in the lengths of resonator taps in adjacent resonators produce different distances between the heads of the resonator taps and the top plate. These differences are often on the order of millimeters, resulting in significantly different compensation requirements for different resonators. With these different requirements, using a single stabilizer strip design for the resonators can produce poor temperature compensation. To improve temperature compensation, this approach often involves redesigning the stabilizer strip dimensions for each cavity, increasing the complexity and cost of manufacture.

SUMMARY OF THE INVENTION

One embodiment of the present invention is directed to a temperature compensating cavity resonator. The resonator includes a cavity resonator housing. The cavity resonator housing has an enclosing plate for enclosing the housing at a top edge, a base, and a surrounding wall extending from the top edge to the base; first and second opposing retainers located below the top edge and at the surrounding wall; a central post having a base end supported by the base of the housing and having a free end surface directed toward the top edge of the housing; and a temperature-compensating metal-based plate assembly. The term "metal-based" in this context refers to and includes metals and other materials having metal coatings, exhibiting similarly signal-reflecting characteristics. The plate assembly includes an upper strip extending from the first opposing retainer to the second opposing retainer and at a distance below the top edge. The cavity resonator housing also includes a lower strip having ends meeting the upper strip and having a center portion arranged over the free end surface and at a distance from the upper strip that varies in response to temperature to maintain a desired effect on energy passing through the cavity resonator housing.

Another particular embodiment of the present invention is directed to a method for manufacturing a temperature-compensated cavity resonator. The method includes providing a cavity resonator housing that has a top edge, a base, and a surrounding wall extending from the top edge to the base. The housing also has first and second opposing recessed retainers located below the top edge and at the surrounding wall and has a central post. The central post extends from the base of the housing to a free end surface that is below a level defined by the top edge of the housing. The method also includes providing a temperature-compensating metal-based plate assembly including an upper strip and ends defined by a length dimension extending from the first opposing retainer to the second opposing retainer and at a distance below the top edge. The plate assembly includes a lower strip having ends secured to the upper strip and having a center portion constructed and arranged at a distance from the upper strip. This distance varies in response to temperature. The temperature-compensating metal-based plate assembly is placed over the free end surface so that the ends of the plate assembly are secured within the first and second opposing recess retainers. A top plate is placed over the housing to enclose the cavity.

The above summary of the present invention is not intended to describe each disclosed embodiment of the present invention. This is the purpose of the figures and of the detailed description that follows.

BRIEF DESCRIPTION OF THE DRAWINGS

Other aspects and advantages of the invention will become apparent upon reading the following detailed description and upon reference to the drawings, in which.

Figure 1:
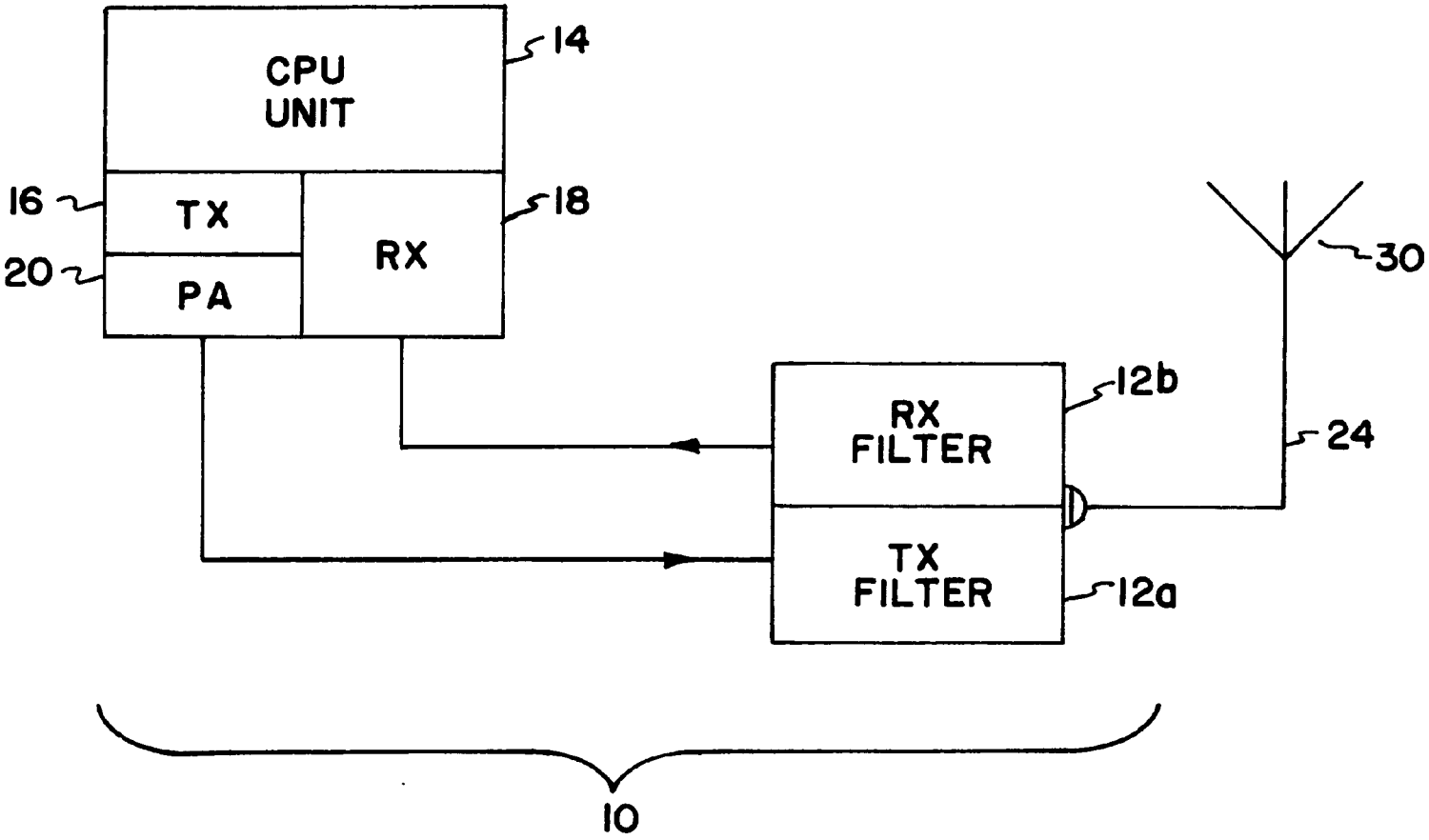
FIG. 1 is an illustration of a radio incorporating a filter structure, according to a particular embodiment of the present invention.

While the invention is susceptible to various modifications and alternative forms, specific embodiments thereof have been shown by way of example in the drawings and will herein be described in detail. It should be understood, however, that the detailed description is not intended to limit the invention to the particular forms disclosed. On the contrary, the intention is to cover all modifications, equivalents, and alternatives falling within the spirit and scope of the invention as defined by the appended claims.

DETAILED DESCRIPTION

The present invention is believed to be applicable to a variety of radio frequency (RF) applications in which temperature compensation is needed or beneficial in maintaining the operation of a cavity resonator structure with respect to its operational frequency band. The present invention has been found to be particularly applicable and beneficial in radio signal conditioning applications, such as RF data and/or voice communication applications, that are susceptible to frequency variations caused by temperature changes. An appreciation of the present invention is best presented by way of a particular example application, in this instance, in the context of cellular communication.

Turning now to the drawings, FIG. 1 illustrates a cellular radio 10 or base station incorporating a pair of filter structures 12*a* and 12*b* according to a particular embodiment of the present invention. The radio 10 is depicted generally so as to represent a wide variety of arrangements and constructions. The illustrated radio 10 includes a CPU-based central control unit 14, audio and data signal processing circuitry 16 and 18 for the respective transmit and receive signaling, a power amplifier 20 for the transmit signaling, and a coaxial cable 24. The coaxial cable 24 carries both the transmit and receive signals between the radio 10 and an antenna 30. The purpose of the filters 12*a* and 12*b* is to ensure that signals in a receive (RX) frequency band do not overlap with signals in a neighboring transmit (TX) frequency band.

Figure 2:
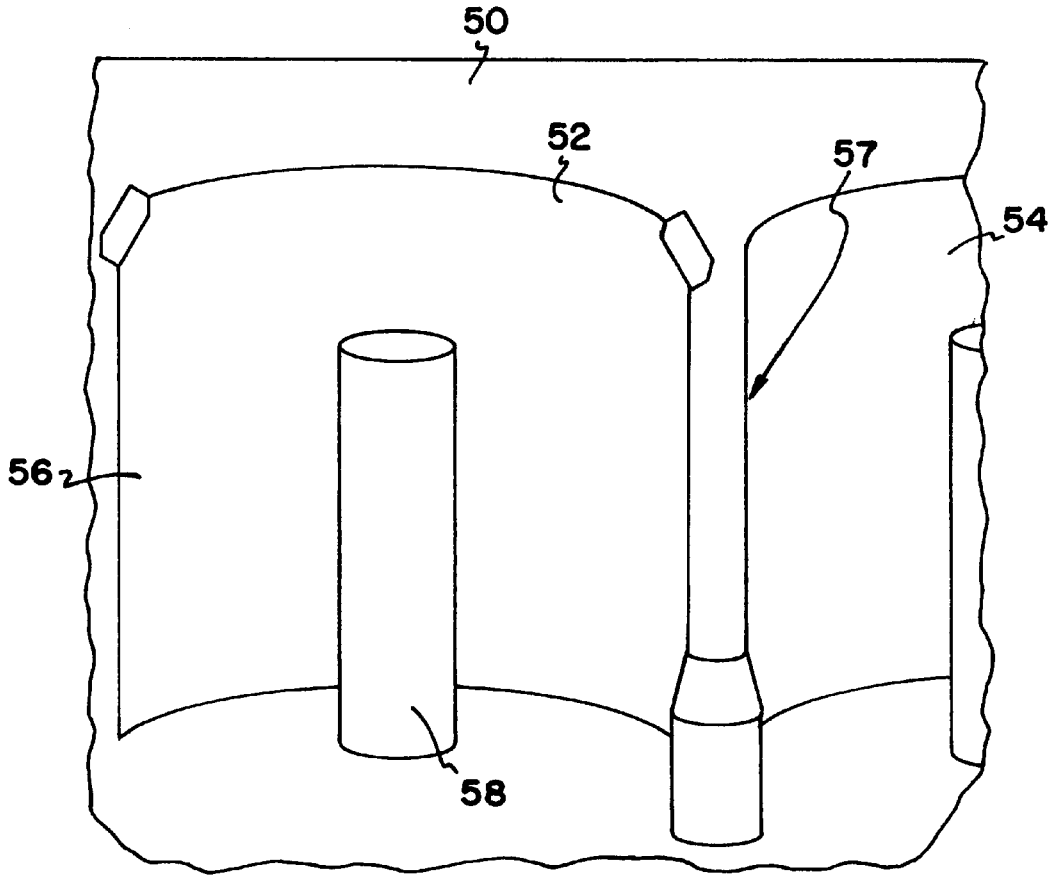
FIG. 2 is a cut-away perspective view of another filter structure, according to one embodiment of the present invention.

FIG. 2 shows an example filter structure for implementing each of the filters 12*a* and 12*b* in a perspective, cut-away view with a full-enclosure housing cover (not shown) removed. The filter structure includes several resonator cavities enclosed in a conductive housing 50. FIG. 2 illustrates the conductive housing 50 enclosing adjacently-located cavities 52 and 54 that implement coaxial resonators.

The cavity 52 providing the notch filter need not be located in the first location as shown, but can be arranged at any location along the energy path. A conductive wall 56 separates the cavities 52 and 54. The conductive wall 56 may be implemented using either a separate insert or manufactured as part of the housing 50. In the specific implementation of FIG. 2, the wall 56 forms part of each cavity 52 and 54. The wall 56 may include an aperature 57 for coupling energy from one cavity 52 to another 54 or vice versa.

A resonator tap 58 is located inside the cavity 52 and causes the structure to act as a notch filter. The resonant frequency $f_r$ of the filter can be approximated using the following equation:

$$f_r = \frac{c}{2\pi\sqrt{\varepsilon_r}}\left[al\left(\frac{a}{2d} - \frac{2}{\pi}\ln\frac{0.765}{\sqrt{l^2+(b-a)^2}}\right)\ln\frac{b}{a}\right]^{-1/2}$$

where a is the radius of the resonator tap 58, b is the radius of the cavity 52, 1 is the height of the cavity 52, and d is the gap or distance between the top of the resonator tap 58 and the top of the cavity 52. These dimensions change in response to temperature variations, affecting the resonant frequency $f_r$ of the filter. For example, an increase in a, b, or 1 causes $f_r$ to decrease. Conversely, $f_r$ increases as d increases. Other known relationships are similarly used for cavity structures determining other filter operations, such as band-pass, low-pass, and high-pass filters.

To compensate for the effects of thermal expansion, the materials forming the structure illustrated in FIG. 2 have different thermal expansion characteristics. For example, according to one aspect of the present invention for the notch filter of FIG. 2, the resonator tap 58 is formed from a material, such as steel, having a smaller coefficient of linear thermal expansion (CLTE) $\alpha_r$ than the conductive housing 50. The CLTE of the gap $\alpha_d$ can thus be expressed using the equation:

$$\alpha_d = \frac{l\alpha_l - (l-d)\alpha_r}{d}$$

where $\alpha_1$ is the CLTE of the material forming the conductive housing 50 and 1 is the height of the cavity 52.

According to another aspect of the present invention, a cavity resonator incorporates a stabilizer strip to adjust the distance between the top of the resonator tap 58 and the top of the cavity 52.

Figure 3:
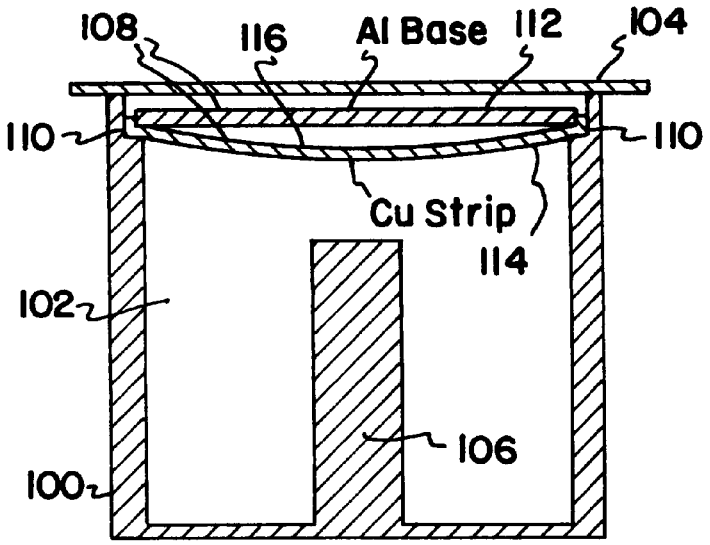
FIG. 3 is a side view of a temperature-compensated cavity resonator, according to another particular embodiment of the present invention.
Figure 4:
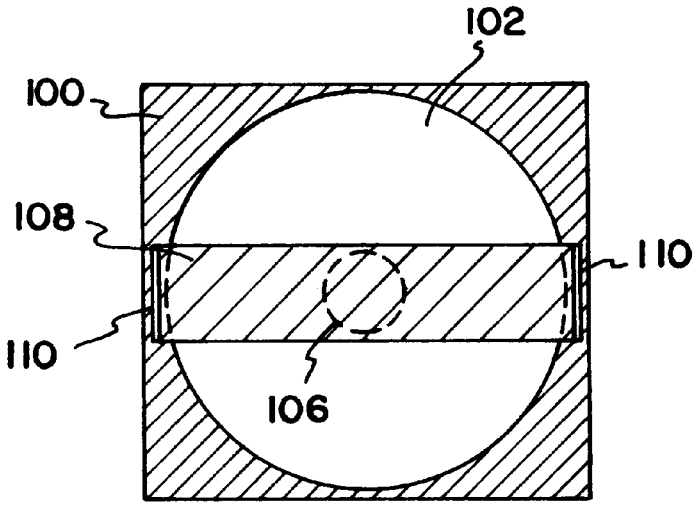
FIG. 4 is a top view of the temperature-compensated cavity resonator illustrated in FIG. 3.

FIGS. 3 and 4 respectively illustrate side and top views of a cavity resonator that compensates for thermal expansion, according to a particular example embodiment of the present invention. A conductive housing 100 formed from, for example, aluminum, defines a cavity 102. A plate 104 secured to the conductive housing 100 defines the top of the cavity 102. It should be noted that FIG. 4 depicts the cavity resonator with the plate 104 removed. Inside the cavity resonator, a resonator tap 106 extends from the bottom of the conductive housing 100 into the cavity 102. The resonator tap 106 and the conductive housing 100 are formed from the same material, e.g., aluminum. Forming the resonator tap and the conductive housing 100 from the same material eliminates the need for a screw or other fastener to attach the resonator tap 106 to the conductive housing 100. This simplifies the assembly process and reduces the cost of manufacturing the filter. Moreover, with the fastener no longer needed, resonators can be placed in vertical as well as horizontal alignment, facilitating compact filter designs.

A stabilizer strip, depicted generally in FIGS. 3 and 4 at reference numeral 108, rests in retainers 110 located along the top of the conductive housing 100. The retainers 110 are illustrated in FIGS. 3 and 4 as implemented as recesses or indentations. The stabilizer strip may be secured in the retainers 110 by, for example, friction or solder. Other techniques for securing the stabilizer strip may be used.

The stabilizer strip 108 consists of a strip assembly. In the embodiment illustrated in FIGS. 3 and 4, the plate assembly includes an upper strip 112 and a lower strip 114. The upper strip 112 is formed from the same material as the conductive housing 100. The lower strip 114 is formed from a material having a different CLTE than the upper strip 112 and conductive body 100. For example, the lower strip 114 may be formed from copper.

The lower strip 114 is curved relative to the upper strip 112, such that a center portion 116 of the lower strip 114 is separated from the upper strip 112 by a distance. In one embodiment, the center portion 116 has a width dimension that is approximately equal to a dimension defining the free end surface of the resonator tap 106. Because the upper and lower strips 112 and 114 are formed from materials having different CLTEs, this distance varies as a function of temperature. Specifically, if the CLTE of the lower strip 114 is lower than the CLTE of the upper strip 112, this distance decreases with increasing temperature. This decrease causes the center portion 116 to recede from the top of the resonator tap 106. The material forming the lower strip 114 is selected such that the center portion 116 recedes more quickly than the resonator tap 106 lengthens when the temperature increases. For example, if the resonator tap 106 is formed from aluminum, the lower strip 114 may be formed from copper. The upper strip 112 and the lower strip 114, or portions thereof may also be implemented using other metal-based materials. With the center portion 116 receding more quickly than the resonator tap 106 lengthens, the distance between the top of the resonator tap 106 and the center portion 116 increases with increasing temperature. This increase in distance increases the resonant frequency, offsetting the decrease in the resonant frequency attributable to other temperature-related dimensional changes.

The foregoing description of the example embodiments of the invention has been presented for the purposes of illustration and description. It is not intended to be exhaustive or to limit the invention to the precise form disclosed. Many modifications and variations are possible in light of the above teaching. For example, structures similar to the stabilizer strip can be used to compensate for other dimensional changes, such as changes in the height of the cavity, and the performance of the dielectric resonator can be improved by inserting dielectric material inside the resonator cavity. It is intended that the scope of the invention be limited not with this detailed description, but rather by the claims appended hereto.

The lower strip 114, as an alternative implementation, can be arranged such that its ends are connected to the upper strip 112 before this strip assembly is placed over the top of the cavity. The ends of the lower strip 114, in this implementation connect just at the inside of, and not supported by, the cavity side walls. The lower strip 114 can be connected to the upper strip 112 using any of a variety of conventional approaches, including, for example, soldering, chemical adhesion, snap-fit and riveting. A significant advantage of this implementation is that it facilitates assembly since the strip assembly can be handled as one device rather than two devices.

What is claimed is:

1. A temperature-compensated resonator, comprising:

a cavity resonator housing having an enclosing plate for enclosing the housing at a top edge, a base and a surrounding wall extending from the top edge to the base;

first and second opposing retainers located below the top edge and at the surrounding wall;

a central post having a base end supported by the base of the housing and having a free end surface directed toward the top edge of the housing; and a temperature-compensating metal-based strip assembly including an upper strip extending from the first opposing retainer to the second opposing retainer and at a distance below the top edge, and including a lower strip having ends meeting the upper strip and having a center portion arranged over the free end surface and at a distance from the upper strip that varies in response to temperature to maintain a desired effect on energy passing through the cavity resonator housing.

2. A temperature-compensated resonator, according to claim 1, wherein the first and second opposing retainers comprise recesses in the cavity resonator housing extending down from the top edge.

3. A temperature-compensated resonator, according to claim 2, wherein the upper and lower strips are secured within the recesses.

4. A temperature-compensated resonator, according to claim 2, wherein the lower strip is assembled into the recesses while it is secured to the upper strip.

5. A temperature-compensated resonator, according to claim 2, wherein the upper and lower strips are secured within the recesses by friction.

6. A temperature-compensated resonator, according to claim 2, wherein the upper and lower strips are secured within the recesses by solder.

7. For use within and as part of a temperature-compensated cavity resonator having a cavity defined by a housing having a top, a base, and a surrounding wall extending from the top to the base, a temperature-compensating metal-based plate assembly, comprising:

an upper strip constructed and arranged to extend from a first side of the surrounding wall to a second opposing side of the surrounding wall at a first distance below the top of the housing, and having first and second ends configured and arranged to interlock with respective first and second opposing retainers respectively located at the first and second sides of the surrounding wall; and a flexible metal lower strip having a center portion arranged at a second distance from the top of the housing that varies in response to temperature and is greater than the first distance, the flexible metal lower strip having respective first and second opposing ends constructed to be secured to the first and second ends of the upper strip so that the upper and lower strips form an integral assembly.

8. A temperature-compensating metal-based plate assembly, according to claim 7, wherein the lower strip and the upper strip are constructed and arranged to be secured into recessed retainers in the cavity resonator housing.

9. A temperature-compensating metal-based plate assembly, according to claim 8, wherein the lower strip and the upper strip are constructed and arranged to be secured to one another while placed into the recessed retainers.

10. A temperature-compensating metal-based plate assembly, according to claim 7, wherein the lower strip is composed of copper.

11. A temperature-compensating metal-based plate assembly, according to claim 7, wherein the upper and lower strips are secured to one another by friction.

12. A filter constructed and arranged to filter radio signals, comprising:

a plurality of temperature-compensated resonators, at least one of the resonators having a cavity resonator housing having an enclosing plate for enclosing the housing at a top edge, a base, and a surrounding wall extending from the top edge to the base, first and second opposing retainers located below the top edge and at the surrounding wall, a central post having a base end supported by the base of the housing and having a free end surface directed toward the top edge of the housing, and a temperature-compensating metal-based plate assembly including an upper strip extending from the first opposing retainer to the second opposing retainer and at a distance below the top edge, and including a lower strip having ends meeting the upper strip and having a center portion arranged over the free end surface and at a distance from the upper strip that varies in response to temperature to maintain a desired effect on energy passing through the cavity resonator housing;

another of the plurality of resonators formed simultaneously with and located adjacent said at least one of the resonators; and a wall separating the adjacently located resonators and including an aperture for coupling energy from one of the adjacently located resonators to the other of the adjacently located resonators.

13. A filter, according to claim 12, wherein the first and second opposing retainers comprise recesses in the cavity resonator housing and extending down from the top edge.

14. A filter, according to claim 13, wherein the center portion has a width dimension that is approximately equal to a dimension defining the free end surface of the conductor post.

15. A radio, comprising:

a transmitter;

a receiver;

at least one antenna coupled to the transmitter and receiver;

at least one filter, constructed and arranged to filter radio signals, coupled to said at least one antenna for a selected frequency band, said at least one filter including a temperature-compensated resonator having a cavity resonator housing having an enclosing plate for enclosing the housing at a top edge, a base, and a surrounding wall extending from the top edge to the base, first and second opposing retainers located below the top edge and at the surrounding wall, a central post having a base end supported by the base of the housing and having a free end surface directed toward the top edge of the housing, and a temperature-compensating metal-based plate assembly including an upper strip extending from the first opposing retainer to the second opposing retainer and at a distance below the top edge, and including a lower strip having ends meeting the upper strip and having a center portion arranged over the free end surface and at a distance from the upper strip that varies in response to temperature to maintain a desired effect on energy passing through the cavity resonator housing.

16. A method for manufacturing a temperature-compensated resonator, comprising:

providing a cavity resonator housing having a top edge, a base, and a surrounding wall extending from the top edge to the base, having first and second opposing recessed retainers located below the top edge and at the surrounding wall, and having a central post extending from the base of the housing to a free end surface stopping below the top edge of the housing;

providing a temperature-compensating metal-based plate assembly including an upper strip and ends defined by a length dimension extending from the first opposing retainer to the second opposing retainer and at a distance below the top edge, and including a lower strip having ends secured to the upper strip and having a center portion constructed and arranged at a distance from the upper strip that varies in response to temperature;

placing the temperature-compensating metal-based plate assembly over the free end surface so that the ends of the plate assembly are secured within the first and second opposing recessed retainers; and placing a top plate over the housing to enclose the cavity.

17. The temperature-compensating metal-based plate assembly of claim 7, wherein the upper strip is formed of a same metal as the housing of the temperature-compensated cavity resonator.

18. The temperature-compensating metal-based plate assembly of claim 7, wherein the upper strip comprises aluminum.

19. The temperature-compensating metal-based plate assembly of claim 7, wherein the lower strip has a smaller coefficient of linear thermal expansion than the upper strip.

* * * * *